US011220408B2

(12) United States Patent
Persson

(10) Patent No.: US 11,220,408 B2
(45) Date of Patent: Jan. 11, 2022

(54) FEEDING SYSTEM FOR CARTON BLANKS

(71) Applicant: Tetra Laval Holdings & Finance S.A., Pully (CH)

(72) Inventor: Richard Persson, Häljarp (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 80 days.

(21) Appl. No.: 16/606,147

(22) PCT Filed: Mar. 23, 2018

(86) PCT No.: PCT/EP2018/057408
§ 371 (c)(1),
(2) Date: Oct. 17, 2019

(87) PCT Pub. No.: WO2018/192739
PCT Pub. Date: Oct. 25, 2018

(65) Prior Publication Data

US 2020/0039768 A1 Feb. 6, 2020

(30) Foreign Application Priority Data

Apr. 19, 2017 (EP) ..... 17167141

(51) Int. Cl.
*B65H 3/08* (2006.01)
*B65H 3/42* (2006.01)
*B65B 43/18* (2006.01)

(52) U.S. Cl.
CPC ..... *B65H 3/0883* (2013.01); *B65B 43/185* (2013.01); *B65H 3/42* (2013.01); *B65H 2403/53* (2013.01); *B65H 2701/1764* (2013.01)

(58) Field of Classification Search
CPC .... B65H 3/0883; B65H 3/42; B65H 2403/53; B65H 2701/1764; B65H 3/0808; B65H 3/0816; B65H 3/085; B65B 43/185
See application file for complete search history.

(56) References Cited

U.S. PATENT DOCUMENTS 5,144,789 A * 9/1992 Focke ..... B65B 19/228
414/412
5,234,314 A * 8/1993 Ganz ..... B65H 3/0808
414/797

(Continued)

FOREIGN PATENT DOCUMENTS

CN 105857747 A 8/2016
DE 10204932 A1 8/2003

(Continued)

OTHER PUBLICATIONS

International Search Report and Written Opinion of the International Searching Authority for International Application No. PCT/EP2018/057408, dated Jun. 11, 2018, in 12 pages.

(Continued)

*Primary Examiner* — Jeremy R Severson
(74) *Attorney, Agent, or Firm* — Knobbe, Martens, Olson & Bear, LLP

(57) ABSTRACT

A feeding system for carton blanks is disclosed, comprising a pivotable linkage, a gripper head connected to the pivotable linkage at a first rotational axis. The feeding system comprises a magazine configured to store a plurality of stacked carton blanks in a stacking direction. The carton blanks are confined in a cassette being dimensioned so that the carton blanks are confined to extend between proximal and distal internal surfaces of the cassette along a cassette direction which is perpendicular to the stacking direction and the first rotational axis. The proximal internal surface is arranged to align proximal edges of the carton blanks in a proximal alignment plane being perpendicular to the cassette direction, the proximal alignment plane extending between the gripper head and said first rotational axis. The first rotational joint is positioned in relation to the magazine such (Continued)

that there is a separation distance between the proximal alignment plane and the first rotational axis.

13 Claims, 9 Drawing Sheets

(56) References Cited

U.S. PATENT DOCUMENTS

| | | | | |
|---|---|---|---|---|
| 5,715,657 | A * | 2/1998 | Mondani | B31B 50/80 53/457 |
| 6,666,447 | B2 * | 12/2003 | Keller | B65H 3/0875 271/101 |
| 8,602,956 | B2 * | 12/2013 | Monti | B65B 43/185 493/314 |
| 2002/0091052 | A1 | 7/2002 | Baumeister et al. | |

FOREIGN PATENT DOCUMENTS

| | | | |
|---|---|---|---|
| GB | 1196709 | A | 7/1970 |
| WO | WO 98/42604 | A2 | 10/1998 |
| WO | WO 2012/028436 | A1 | 3/2012 |
| WO | WO 2015/091977 | A1 | 6/2015 |

OTHER PUBLICATIONS

Extended European Search Report issued in European Patent Application No. 17167141, dated Oct. 30, 2017, in 9 pages.
Search Report issued in Chinese Patent Application No. 201810300255.8, dated Jul. 17, 2020, in 2 pages.
Office Action issued in Chinese Patent Application No. 201810300255.8, dated Jul. 27, 2020, in 5 pages.
European Search Report issued in European Patent Application No. 18163513, dated Aug. 31, 2018, in 2 pages.
Office Action issued in Japanese Patent Application No. 2019-556902, dated Sep. 17, 2021, in 8 pages.

* cited by examiner

FEEDING SYSTEM FOR CARTON BLANKS

CROSS-REFERENCE TO RELATED APPLICATIONS

This application is the U.S. National Phase under 35 U.S.C. § 371 of International Application PCT/EP2018/057408, filed Mar. 23, 2018, which claims priority to EP Application No. 17167141.5, filed Apr. 19, 2017, the entire contents of each of which are incorporated by reference herein and made a part of this specification.

TECHNICAL FIELD

The present invention generally relates to the field of filling systems and feeding systems thereof for feeding carton blanks. More particularly, the present invention relates to a feeding system having a rotary feeder with a pivotable linkage for transporting carton blanks from a magazine to a folding- and transportation unit. A filling system and a related method of feeding carton blanks with a rotary feeder are also provided.

BACKGROUND

In the field of carton based packaging for liquid food products, there are generally two main types of systems; roll fed systems and blanks fed systems. In the roll fed systems, a roll of packaging material is fed to the system where it is shaped into a tube, which in turn is filled with a liquid food product and then transversally sealed off into individual containers along the tube. In the carton blanks fed systems, the packaging material is prepared before being fed to the system by cutting the packaging material into pieces, wherein each piece corresponds to one package. Each piece is shaped into a sleeve-shaped body being longitudinally sealed, and possibly provided with weakening lines in order to facilitate further folding. The sleeve shaped packaging material pieces are usually referred to as blanks. In the filling machine these are stacked in a planar configuration in a magazine, i.e. in a configuration where the sleeve-shaped blanks has been collapsed into a flat shape, usually with the openings placed vertically. According to one way of operating a blank fed system, a blank is fetched from the magazine by a rotary feeder, and then manipulated so that the sleeve assumes a more or less rectangular cross-section. One end of the sleeve is closed and sealed such that a package with an open end is formed. Next, the package is filled with a liquid product via the open end, and finally the open end of the package is sealed and closed.

The blanks may be produced at one site, sometimes referred to as a converting factory, and transported to another site where the filling system is placed. During the transportation there is a risk that the blanks are squeezed together such that inner sides of the blanks stick to each other, or that close lying blanks stick to each other. Therefore, is a challenge to make sure that the blanks can be fetched, one-by-one, from the magazine at high speeds, e.g. fetching more than one blank per second, and in a robust way with few unwanted interruptions. Failure to provide a reliable feeding system will thus significantly impede the development of high-speed filling systems, and limit the throughput of the production line. A further problem stems from relative movement between the rotary feeder and the stationary magazine in such high-speed systems. The carton blanks must be extracted from their planar stacked configuration in the magazine to the rotary feeder with high accuracy, which is further challenged by the flexible nature of the planar blanks, meaning there will be an inherent delay of the momentaneous position thereof relative the rotary feeder. The arrangement of the trajectory of the feed paths of the carton blanks and the rotary feeder is thus critical to assure a reliable extraction of the blanks as the speed of the system is increased. Prior art systems have problems in achieving such reliability due to less optimal arrangement of such feed paths.

Hence, an improved feeding system would be advantageous and in particular allowing for avoiding more of the above mentioned problems and compromises, and providing for a more reliable extraction of carton blanks from a magazine in a rotary feeder in a high-speed production line.

SUMMARY

Accordingly, examples of the present invention preferably seeks to mitigate, alleviate or eliminate one or more deficiencies, disadvantages or issues in the art, such as the above-identified, singly or in any combination by providing a device according to the appended patent claims.

According to a first aspect a feeding system for carton blanks is provided. The feeding system comprises a rotary feeder comprising a pivotable linkage, and a gripper head connected to the pivotable linkage via a gripper arm, wherein the gripper arm is connected to an outer periphery of the pivotable linkage at a first rotational joint, whereby the gripper arm is rotatable around a first rotational axis thereof. The feeding system comprises a magazine configured to store a plurality of stacked carton blanks each having a planar configuration in a magazine plane of the magazine, when stored therein, the carton blanks being stacked in a stacking direction, parallel with a normal axis to the magazine plane. The pivotable linkage is configured to be movable along a general feed path such that the gripper head follows an approach path towards a picking position at which the gripper head engage with a carton blank in the magazine, and subsequently follows a delivery path, from the picking position to a delivery position. The magazine comprises a cassette in which the carton blanks are confined, when stored in the magazine, the cassette being dimensioned so that the carton blanks are confined to extend in said magazine plane between proximal and distal internal surfaces of the cassette along a cassette direction which is perpendicular to the stacking direction and said first rotational axis. The proximal internal surface is arranged to align proximal edges of the carton blanks in a proximal alignment plane being perpendicular to the cassette direction, the proximal alignment plane extending between the gripper head and said first rotational axis, at least when the gripper head is in the picking position, wherein, at least when the gripper head is in the picking position, the first rotational joint is positioned in relation to the magazine such that there is a separation distance between the proximal alignment plane and the first rotational axis, the separation distance extending in an off-set direction being parallel with the cassette direction.

According to a second aspect a filling system is provided comprising a feeding system according to the first aspect and carton blanks. The feeding system comprises a rotary feeder comprising a pivotable linkage, and a gripper head connected to the pivotable linkage via a gripper arm, wherein the gripper arm is connected to an outer periphery of the pivotable linkage at a first rotational joint, whereby the gripper arm is rotatable around a first rotational axis thereof. The feeding system comprises a magazine configured to store a plurality of stacked carton blanks each having a planar configuration in a magazine plane of the magazine, the carton blanks being stacked in a stacking direction, parallel with a normal axis to the magazine plane. The pivotable linkage is configured to be movable along a general feed path such that the gripper head follows an approach path towards a picking position at which the gripper head engage with a carton blank in the magazine, and subsequently follows a delivery path, from the picking position to a delivery position. The magazine comprises a cassette in which the carton blanks are confined, and the cassette being dimensioned so that the carton blanks are confined to extend in said magazine plane between proximal and distal internal surfaces of the cassette along a cassette direction which is perpendicular to the stacking direction and said first rotational axis. The proximal internal surface is arranged to align proximal edges of the carton blanks in a proximal alignment plane being perpendicular to the cassette direction, the proximal alignment plane extending between the gripper head and said first rotational axis, at least when the gripper head is in the picking position, wherein, at least when the gripper head is in the picking position, the first rotational joint is positioned in relation to the magazine such that there is a separation distance between the proximal alignment plane and the first rotational axis, the separation distance extending in an off-set direction being parallel with the cassette direction.

According to a third aspect a method of feeding carton blanks with a rotary feeder is disclosed. The rotary feeder comprises a pivotable linkage, the pivotable linkage being connected to a gripper head via a gripper arm at a first rotational joint, whereby the gripper arm is rotatable around a first rotational axis thereof. The method comprises moving the pivotable linkage along a general feed path such that the gripper head follows an approach path towards a picking position at which the gripper head engage with a carton blank in a magazine, and subsequently follows a delivery path, from the picking position to a delivery position. The magazine is configured to store a plurality of stacked carton blanks each having a planar configuration in a magazine plane of the magazine, when stored therein, the blanks being stacked in a stacking direction, parallel with a normal axis to the magazine plane. The magazine comprises a cassette in which the carton blanks are confined, when stored in the magazine. The cassette is dimensioned so that the carton blanks are confined to extend in the magazine plane between proximal and distal internal surfaces of the cassette along a cassette direction which is perpendicular to the stacking direction and said first rotational axis, and wherein the proximal internal surface is arranged to align proximal edges of the carton blanks in a proximal alignment plane being perpendicular to the cassette direction. The proximal alignment plane extends between the gripper head and said first rotational axis, at least when the gripper head is in the picking position. Moving the pivotable linkage along a general feed path comprises positioning the first rotational joint in relation to the magazine such that there is a separation distance between the proximal alignment plane and the first rotational axis, the separation distance extending in an off-set direction being parallel with the cassette direction.

Further examples of the invention are defined in the dependent claims, wherein features for the second and third aspects of the disclosure are as for the first aspect mutatis mutandis.

Some examples of the disclosure provide for a filling system that can operate at a higher speed to increase throughput.

Some examples of the disclosure provide for a feeding system in a filling machine that is more reliable at higher speeds.

Some examples of the disclosure provide for a feeding system that is more robust.

Some examples of the disclosure provide for a feeding system that can extract individual carton blanks from a stacked carton blank magazine with increased accuracy and at higher speed.

It should be emphasized that the term "comprises/comprising" when used in this specification is taken to specify the presence of stated features, integers, steps or components but does not preclude the presence or addition of one or more other features, integers, steps, components or groups thereof.

BRIEF DESCRIPTION OF THE DRAWINGS

These and other aspects, features and advantages of which examples of the invention are capable of will be apparent and elucidated from the following description of examples of the present invention, reference being made to the accompanying drawings, in which.

DETAILED DESCRIPTION

Figure 1:
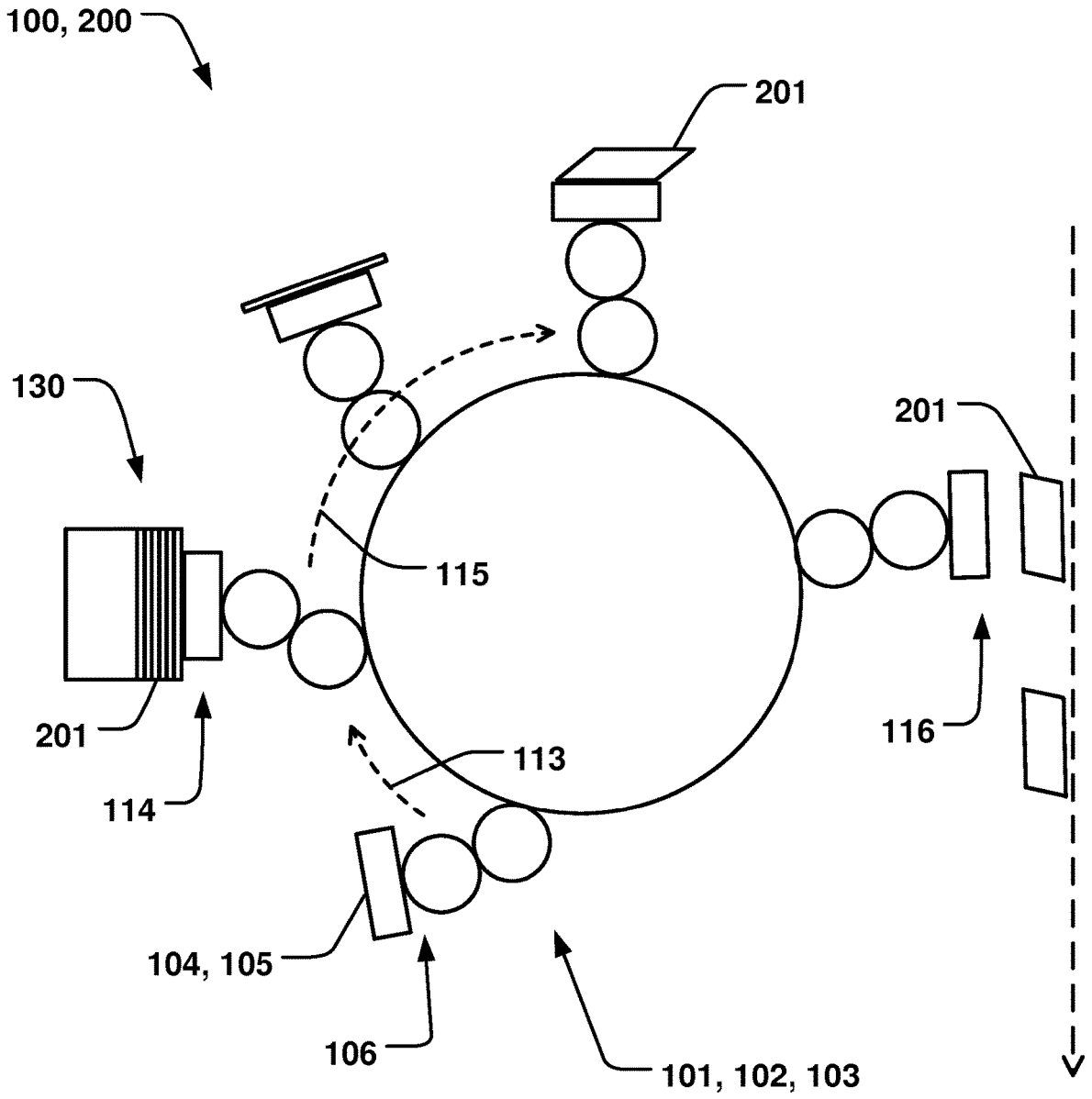
FIG. 1 is a schematic illustration of a rotary feeder in a feeding system, in a top-down view, according to one example.

Specific examples of the invention will now be described with reference to the accompanying drawings. This invention may, however, be embodied in many different forms and should not be construed as limited to the examples set forth herein; rather, these examples are provided so that this disclosure will be thorough and complete, and will fully convey the scope of the invention to those skilled in the art. The terminology used in the detailed description of the examples illustrated in the accompanying drawings is not intended to be limiting of the invention. In the drawings, like numbers refer to like elements.

Figure 2:
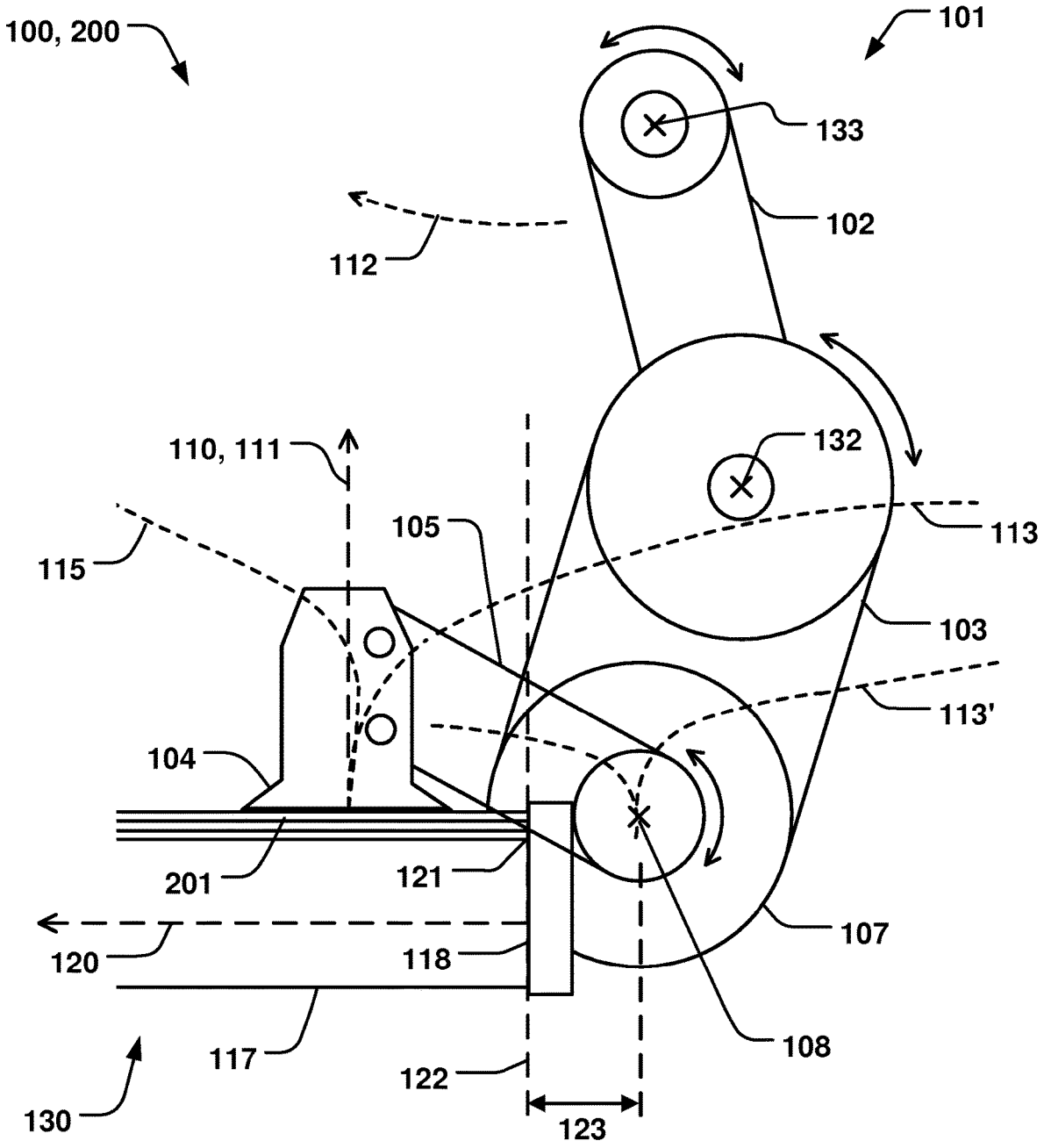
FIG. 2 is a schematic illustration of a feeding system, in a detailed top-down-view, according to one example.

FIG. 2 illustrates a feeding system 100 for carton blanks 201. The feeding system 100 comprises a rotary feeder 101 which comprises a pivotable linkage 102, 103, and a gripper head 104 connected to the pivotable linkage 102, 103, via a gripper arm 105. The rotary feeder 101 and the pivotable linkage 102, 103, thereof move along cyclic path as seen in the overview of FIG. 1. The pivotable linkage 102, 103, extends outward towards the carton blanks 201. The gripper arm 105 is connected to an outer periphery 106 of the pivotable linkage 102, 103, at a first rotational joint 107, which is illustrated in more detail in FIG. 2. The gripper arm 105 is thereby rotatable around a first rotational axis 108 of the first rotational joint 108. In this example, the gripper head 104 has a fixed position in relation to the gripper arm 105, but it is conceivable that it may be rotationally connected to the gripper arm 105 via an additional rotational joint (not shown).

The feeding system 100 comprises a magazine 130 which configured to store a plurality of stacked carton blanks 201, each having a planar configuration in a magazine plane 109 of the magazine 130, when stored therein. The carton blanks 201 are stacked in a stacking direction 110, which is parallel with a normal axis 111 to the magazine plane 109. Thus, each of the carton blanks 201 has been folded into a planar configuration and lie on top of each other in the magazine 130. The pivotable linkage 102, 103, is configured to be movable along a general feed path 112 such that the gripper head 104 follows an approach path 113 towards a picking position 114 at which the gripper head engage with a carton blank 201 in the magazine 130 (the position shown in FIG. 2), and subsequently follows a delivery path 115, from the picking position 114 to a delivery position 116, which is illustrated in the overview of FIG. 1. The gripper head 104 thus pick up the carton blank 201 at the picking position and transports it to the delivery position 116. The carton blank 201 may be manipulated during the delivery path 115 to assume an expanded shape, i.e. by being unfolded to assume a cross-section which is more rectangular. At the delivery position 116, the carton blank 201 is placed in compartments of a conveyor belt moving past the feeding system 100.

Figure 4:
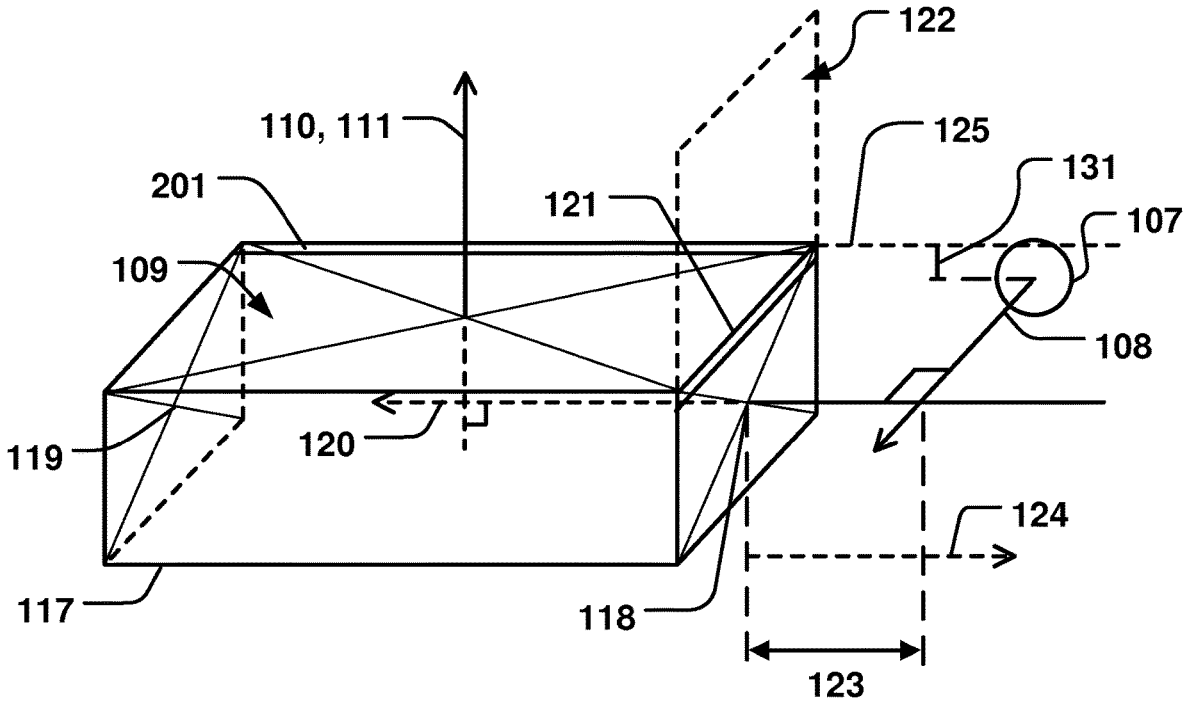
FIG. 4 is a schematic illustration of a coordinate system of a feeding system according to one example.

The magazine 130 comprises a cassette 117 in which the carton blanks 201 are confined, when stored in the magazine 130. The cassette 117 is dimensioned so that the carton blanks 201 are confined to extend in the magazine plane 109 between a proximal internal surface 118 and a distal internal surface 119 of the cassette along a cassette direction 120 which is perpendicular to the stacking direction 110 and the first rotational axis 108. FIG. 4 shows a geometrical overview of the cassette 117 in relation to the first rotational axis 108. The carton blanks 201 are thus stacked in the cassette 117, and extend in a planar configuration from the proximal internal surface 118, closest to the first rotational axis 108, to the distal internal surface 119. The proximal internal surface 118 is arranged to align proximal edges 121 of the carton blanks 201 in a proximal alignment plane 122, which is indicated in FIGS. 2 and 4. The proximal edge 121 of a carton blank 201 may thus correspond to a longitudinal folding line thereof, which lies against the proximal internal surface 118. The proximal alignment plane 122 is perpendicular to the cassette direction 120 and extends between the gripper head 104 and the first rotational axis 108, at least when the gripper head 104 is in the picking position 114, as indicated in FIG. 2, in conjunction with FIG. 4.

Furthermore, the first rotational joint 108 is positioned in relation to the magazine 130 such that there is a separation distance 123 between the proximal alignment plane 122 and the first rotational axis 108, at least when the gripper head 104 is in the picking position 114, as illustrated in e.g. FIGS. 2 and 4. The separation distance 123 extends in an off-set direction 124 which is parallel with the cassette direction 120. Having a separation distance 123 as specified allows for an optimized approach- and delivery path 113, 115, for aligning the gripper head 104 in a position that minimizes any movement thereof in the plane 109 of the magazine 130 while engaging a carton blank 201 in the picking position 114. The movement of the gripper head 104 is thus predominantly concentrated to the direction perpendicular to the plane 109, i.e. along the stacking direction 110, which allows for an efficient pull in this direction to disengage the carton blank 201 from the magazine 130 with a minimum of force exerted on a subsequent carton blank positioned underneath the currently engaged carton blank 201. Thus, although there is a certain friction between subsequently stacked carton blanks 201, the frictional force is minimized, which otherwise could cause dislocation of the next carton blank to be picked by the gripper head 104. While the mentioned advantages are provided for by having such separation distance 123, this also allows for maintaining an optimized position of the gripper head 104 in relation to the position of the carton blanks 201 in the cassette direction 120. I.e. the carton blanks 201 may advantageously be engaged by the gripper head 104 at an optimized distance from the proximal edges 121 of the carton blanks 201. For example, in order for the carton blanks 201 to be properly positioned to allow for further manipulation in a high-speed processing application, e.g. by being folded to assume a rectangular cross-section in subsequent steps in the filling system, the gripper head 104 has an advantageous picking position 114 adjacent, or at a determined optimized distance from the proximal edges 121. Having the specified separation distance 123 thus allows for fulfilling such requirements with respect to where the gripper head 104 should engage the carton blanks 201 to allow for the subsequent processing steps to be carried out, while providing for the previously mentioned advantages in keeping the movement of the gripper head 104 predominantly occurring along the stacking direction 110, when in the picking position 114. This also provides for minimizing the amount of movement of the first rotational joint around the first rotational axis 108 that is required for the gripper head 104 to lift a carton blank 201 the necessary distance from the cassette 117. Since the amount of rotation of the first rotational joint 107 can be reduced, the overall speed of the rotary feeder 101 can be increased, as the time to complete the approach- and delivery paths 113, 115, is reduced. Having a separation distance 123 as specified thus provides for a more reliable and robust feeding system 100 in a high-speed production line. Further, as mentioned above, as the movement of the gripper head 104 can be predominantly concentrated to the direction perpendicular to the plane 109, when in the picking position 114, due to having a separation distance 123 as discussed, the distance by which the gripper head 104 can move substantially parallel to the normal axis 111 when lifting the carton blanks 201 from the magazine 130 is increased. This allows for more effectively pulling the carton blanks 201 in the direction of the normal axis 111, which is in particularly preferred in case the carton blanks 201 are held in place by edges on opposite sides of the magazine 130, which may overlap somewhat with the carton blanks 201 in order to prevent unintentional dislocation thereof in the direction of the normal axis 111. Thus, lifting the carton blanks 201 along an increased distance, substantially parallel with the normal axis 111, provides for more easily disengaging the carton blanks 201 from such edges, while making sure the carton blanks can be kept securely fixated to the magazine 130.

Figure 3A:
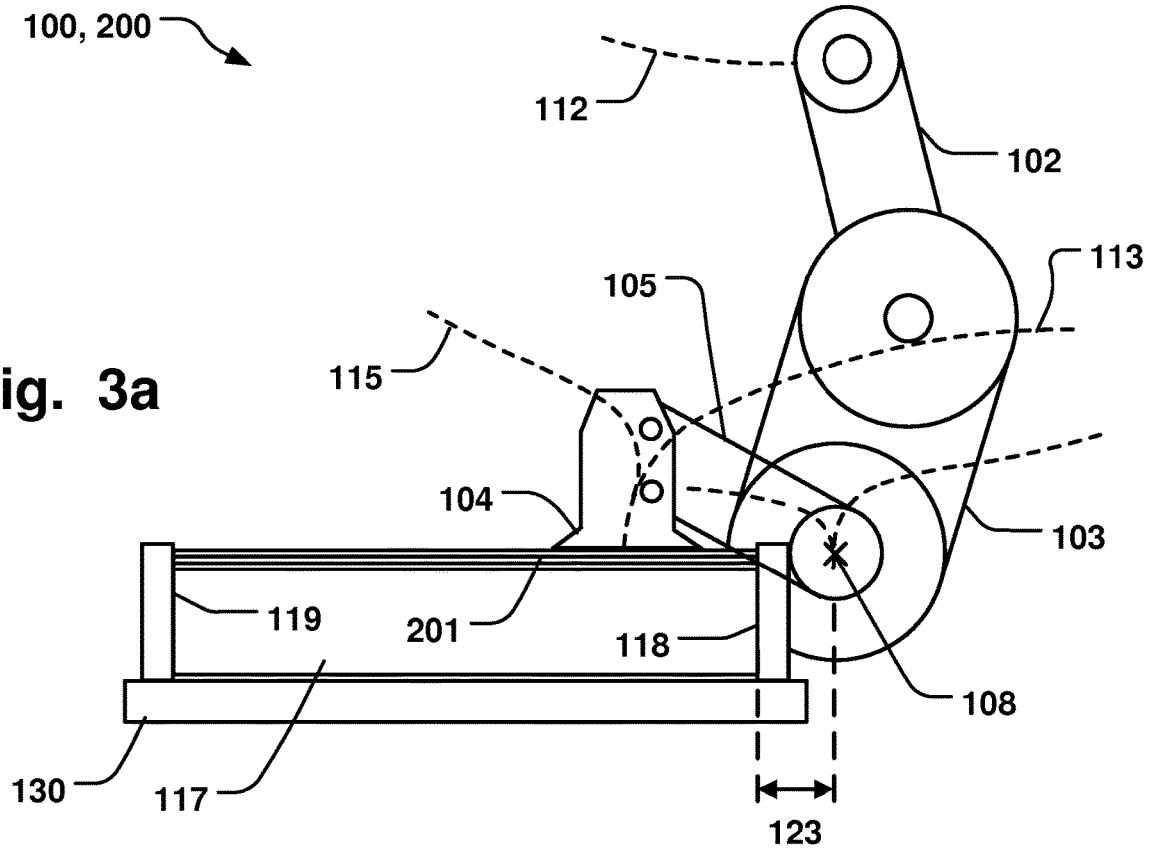
FIGS. 3*a-f* are schematic illustrations of a sequence of extracting a carton blank from a magazine in a feeding system, according to one example.
Figure 3B:
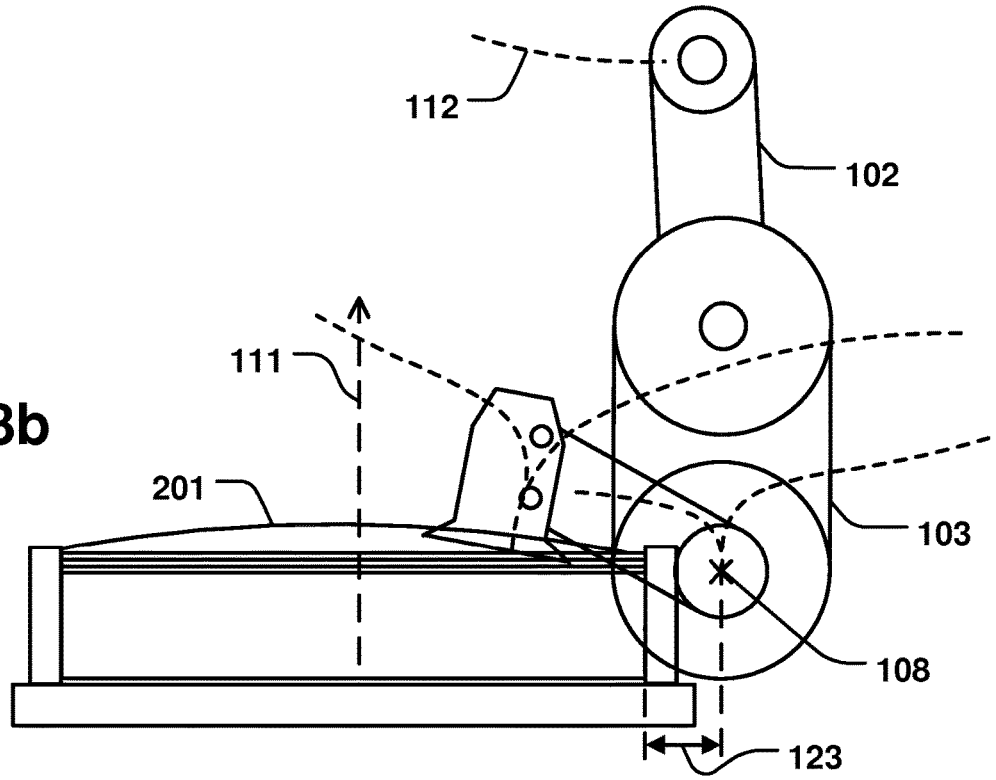
Figure 3C:
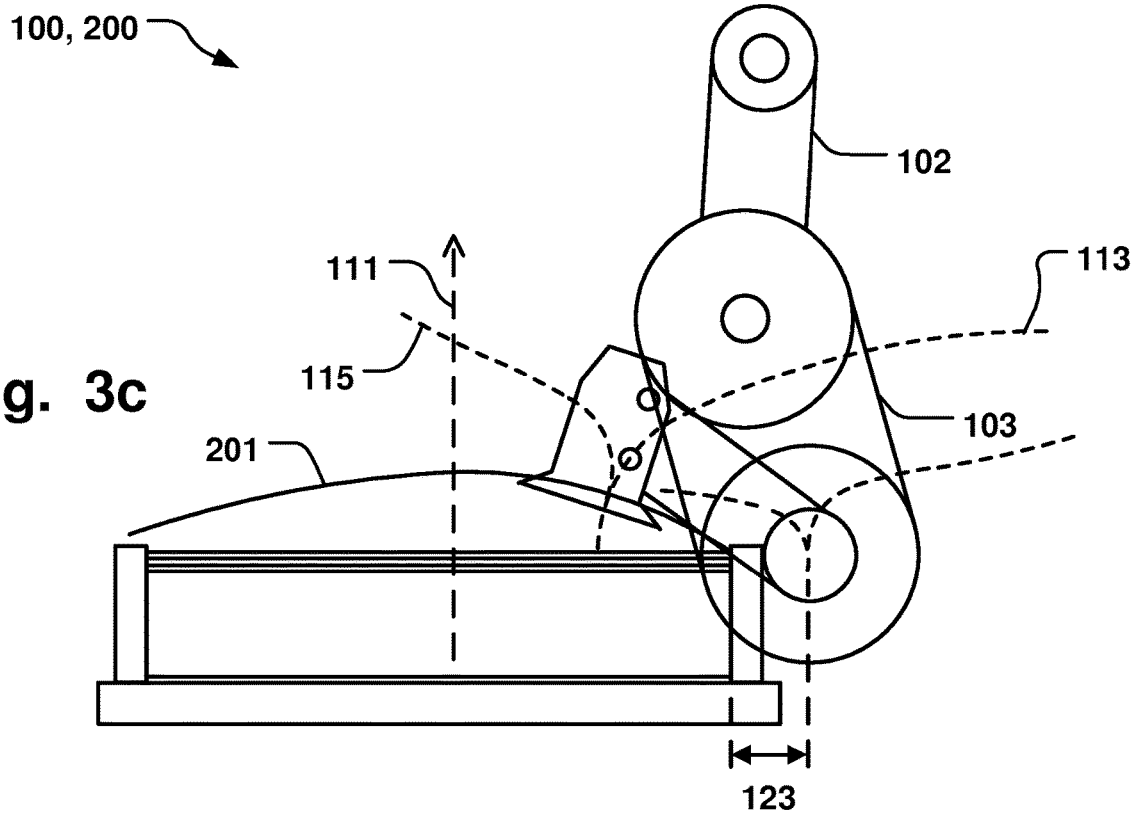
Figure 3D:
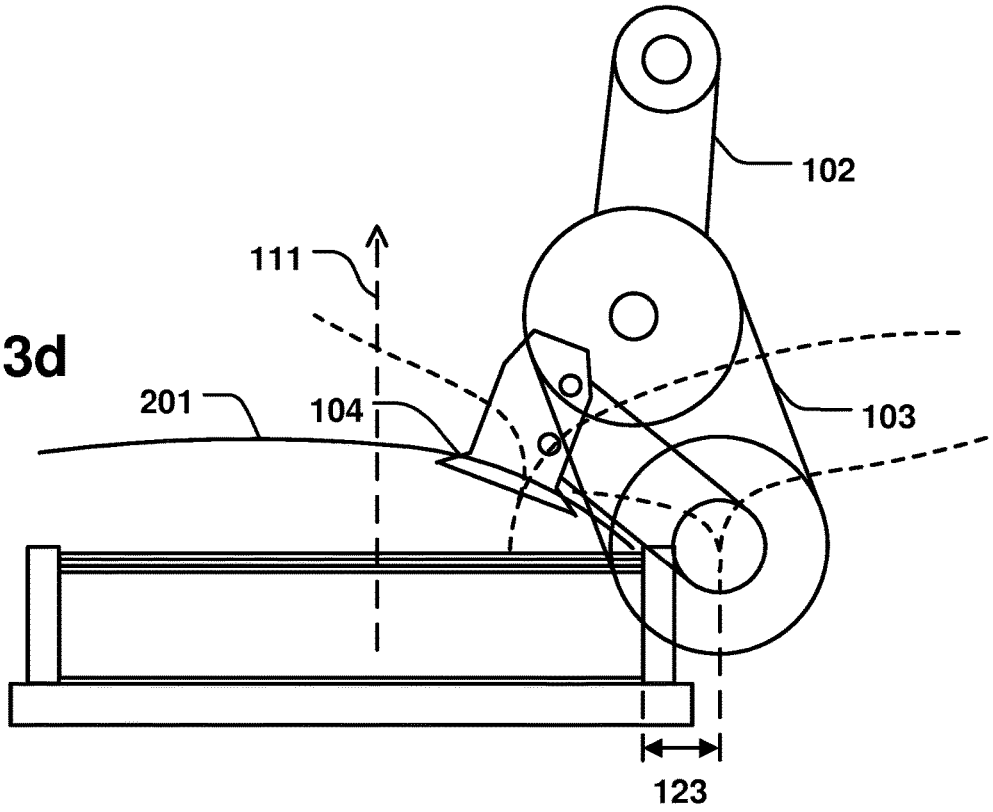
Figure 3E:
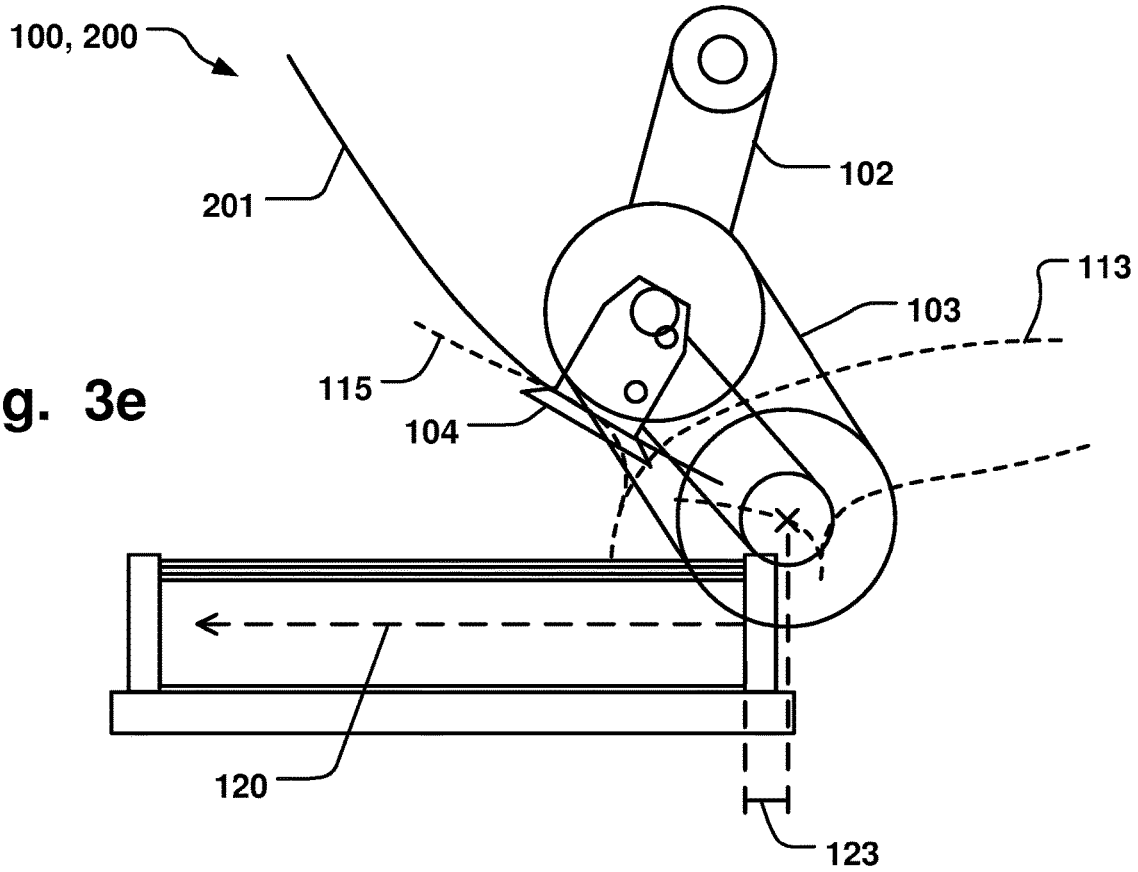
Figure 3F:
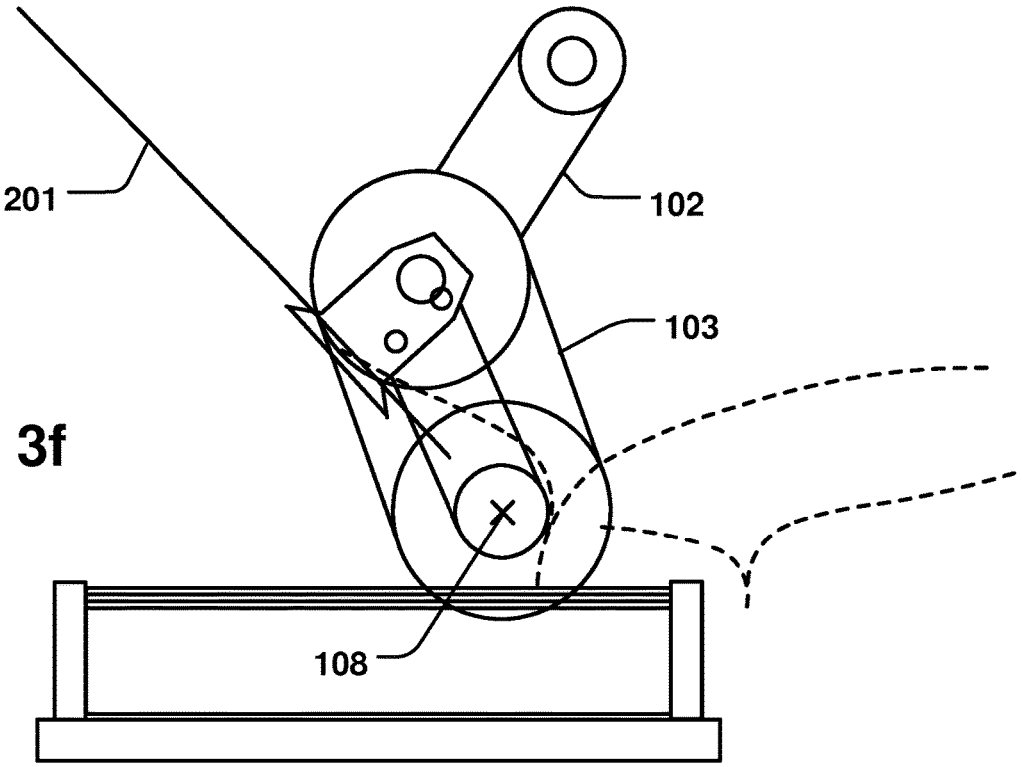

FIGS. 3*a-f* illustrate a sequence of the feeding system 100 where the gripper head 104 extract a carton blank 201 from the magazine 130. As seen in FIG. 3*a*, which corresponds to the snapshot of the feeding system 100 seen in FIG. 2, the first rotational axis 108 has been positioned with a separation distance 123 to the proximal internal surface 118, which coincides with the proximal alignment plane 122, where the proximal edges 121 of the carton blanks 201 lie. The gripper head 104 has also been moved along the approach path 113 to the picking position 114 to engage a carton blank 201. In FIG. 3*b* the pivotable linkage 102, 103, has been advanced further along its general feed path 112 while the first rotational axis 108 is maintained at the separation distance 123, which is provided for by the opposite rotational directions of the first and second pivotable linkages 102, 103. Simultaneously, the gripper head 104 has started to rotate about the first rotational axis 108 to lift the carton blank 201 from the magazine 130. As elucidated above, having arranged the first rotational axis 108 at the separation distance 123 as specified allows for maintaining the picking position 114 close to the proximal internal surface 118 while minimizing the amount of movement of the gripper head 104 along the plane 109 in which the carton blanks 201 extend, for a given amount of rotation around the first rotational axis 108. In FIGS. 3*c-d* the pivotable linkage 102, 103, assumes further advancement and gripper head 104 continues to rotate around the first rotational axis 108 to lift the carton blank 201 from the magazine 130, while the first rotational axis 108 is arranged at the separation distance 123 from the proximal alignment plane 122. The gripper head 104 moves further along the delivery path 115 in FIGS. 3*e-f* and starts to move in a direction having an increased trajectory vector component along the plane 109, i.e. along the cassette direction 120. In FIG. 3*e,* the separation distance 123 has been reduced, as the gripper head 104 moves along the feed path 115 having a trajectory vector component along the cassette direction 123. In FIG. 3*f* the pivotable linkage 102, 103, starts to move past the magazine 130, and the next gripper head will then arrive at the picking position 104.

Figure 5A:
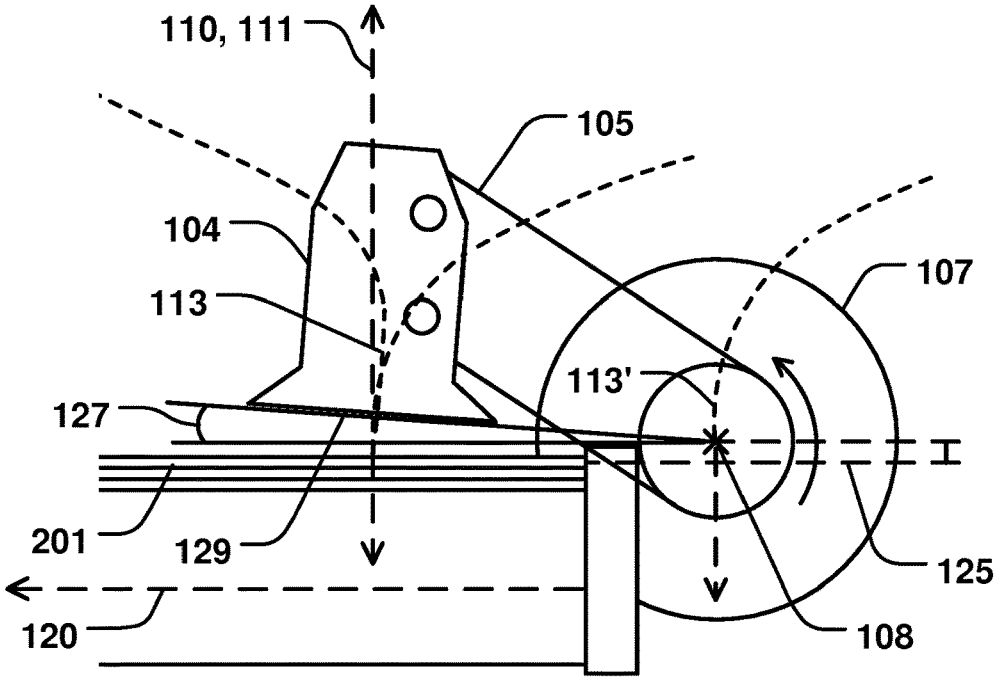
FIGS. 5*a-c* are schematic illustrations of a sequence of extracting a carton blank from a magazine in a feeding system, in a detailed view, according to one example.
Figure 5B:
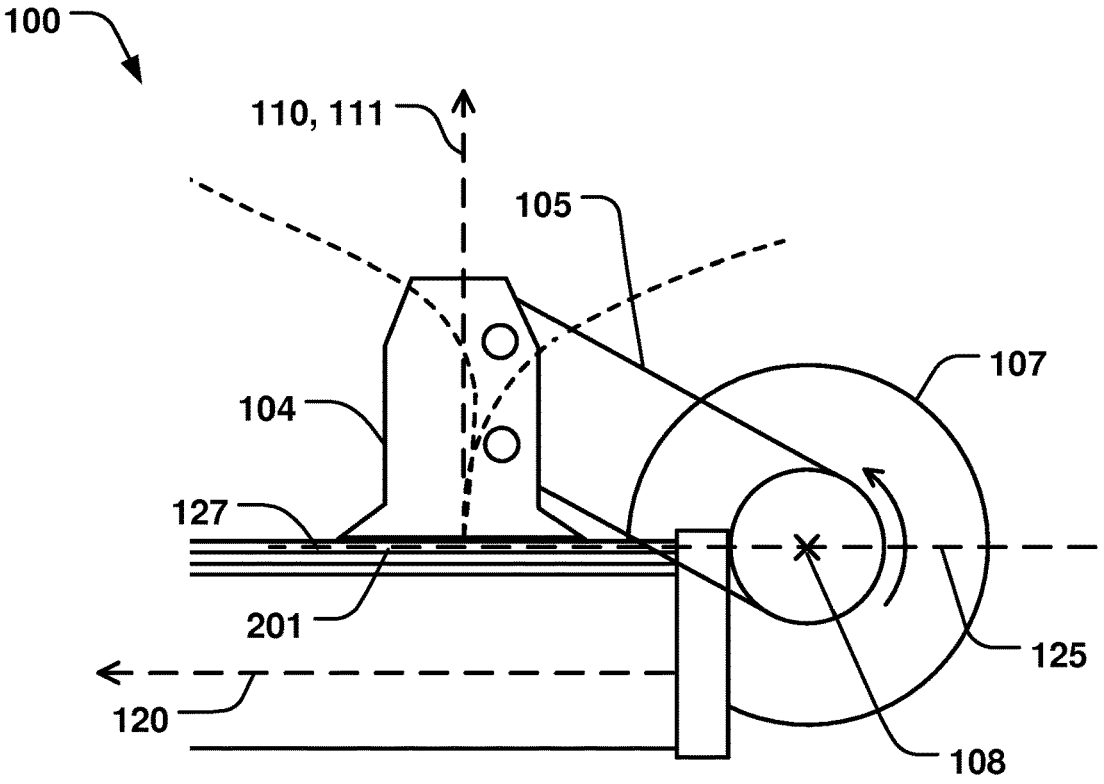
Figure 5C:
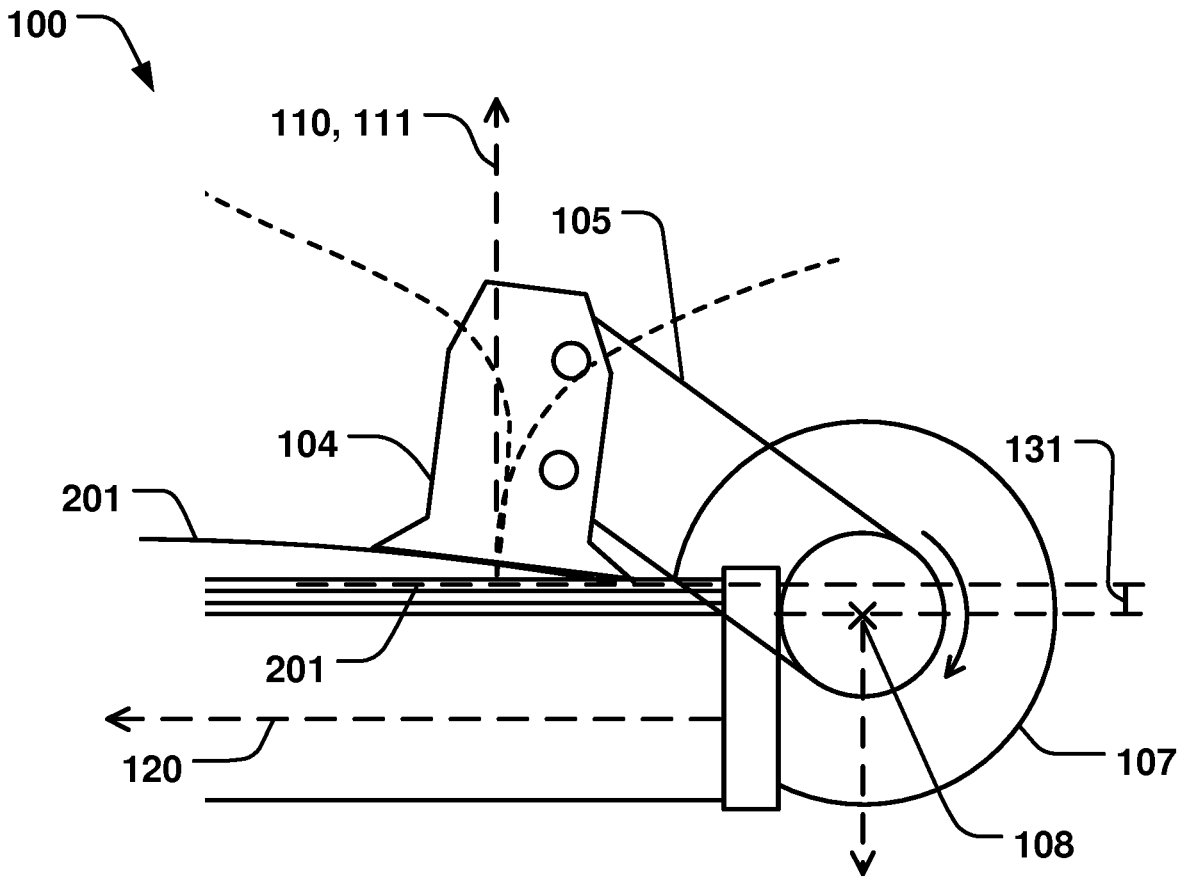

When the gripper head 104 is in the picking position 114 and in engagement with a first carton blank 201 that extends along a first longitudinal axis 125, which is parallel with the cassette direction 120, the first rotational axis 108 may be positioned such that the first longitudinal axis 125 extends between the gripper head 104 and the first rotational axis 108 in the stacking direction 110, which is illustrated in the geometrical overview of FIG. 4. I.e. considering a first carton blank 201 that lies on top of the stack of blanks in the cassette 117, where it extends in a planar configuration along a first longitudinal axis 125, which is parallel to the cassette direction 120, the first rotational axis 108 is positioned below the first carton blank 201, relative to the stacking direction 110. The position of the first rotational axis 108 relative the first carton blank 201 in this direction is indicated by the distance 131 in FIG. 4. By having the first rotational axis 108 moving below the first carton blank 201, the amount time available for the gripper head 104 to engage the first carton blank 201 at the picking position 114 may be increased since the movement of the rotary feeder 101 and the pivotable linkage 102, 103, thereof may be absorbed by moving the first rotational axis 108 in the stacking direction 110 while keeping the gripper head 104 substantially stationary in the cassette direction 120, i.e. perpendicular to the stacking direction 110. The amount of time available for the gripper head 104 to lift the first blank 201 in the stacking direction, before having to move along the delivery path 115 with a vector component in the cassette direction 120, is thus increased. This will in turn make the extraction more reliable and safe. FIGS. 5*a-c* are further detailed views of a sequence in which the gripper head 104 engage and lift a carton blank 201 from the magazine 130, and will be discussed in further detail below. FIG. 5*a* is a snapshot of the gripper head 104 just before a first carton blank 201 is engaged, and where the first rotational axis 108 is still aligned above the first longitudinal axis 125 of the first carton blank 201. FIG. 5*b* shows the initial contact between the gripper head 104 and the first carton blank 201. In this position, the position of the first rotational axis in the stacking direction 110 may be substantially aligned with the first longitudinal direction 125. In FIG. 5*c,* the rotation of the gripper arm 105 and gripper head 104 around the first rotational axis 108 has initiated the lift of the carton blank 201 from the magazine 130, as the first rotational axis 108 has continued to move below the first longitudinal direction 125 as described above.

The first rotational axis 108 and the gripper head 104 may be movable along respective approach paths 113, 113', that are at least partly aligned substantially in parallel with the stacking direction 110, when the gripper head 104 is in the picking position 114, as illustrated in e.g. FIGS. 2 and 5*a*. This advantageously provides for a minimal amount of translatory movement of the gripper head 104 in directions perpendicular to the stacking direction 110, as both the gripper head 104 and the first rotational joint 107 move along substantially parallel approach paths 113, 113', in this direction. The carton blanks 201 can thereby be efficiently pulled upwards with a minimal risk of dislocating any subsequent carton blank.

The approach path 113 and the delivery path 115 of the gripper head 104 may be at least partly aligned substantially in parallel, when the gripper head 104 is in the picking position 114. FIG. 2 illustrates that there is a portion of the approach- and delivery paths 113, 115, of the gripper head 104 that are aligned predominantly in the same direction, substantially parallel with the stacking direction 110, or with a minimum trajectory vector component extending in the cassette direction 120. Such arrangement of the approach- and delivery paths 113, 115, is facilitated due to having the separation distance 123 as specified. Without such separation distance 123 the radius of curvature of the approach- and delivery paths 113, 115, would be reduced and the portion of the trajectory vector component extending in the cassette direction 120 would be increased, with greater risk of causing frictional forces between the carton blanks 201 in this direction.

The proximal alignment plane 122 and the first rotational axis 108 may be separated by the separation distance 123 while a first blank 201, engaged by the gripper head 104, is in contact with the magazine 130. This is illustrated for example in the sequence of snapshots in FIGS. 3*a-e,* where FIG. 3*e* shows that a first blank 201 as been completely disengaged from the magazine 130, while the first rotational axis 108 is maintained at a separation distance 123 from the proximal alignment plane 122 as discussed above. Delaying the position if the first rotational axis 108 outside the magazine may thus make sure that the carton blank 201 is pulled completely out of the magazine 130 before commencing the portion of the delivery path 115 that has a vector component in the cassette direction 120, to avoid any interference such as pushing action on the following carton blanks in the stack.

The first rotational joint 107 may rotate in a first direction when following the approach path 113', until the gripper head 104 arrives at the picking position 114 and contacts a first carton blank 201. The first direction may be a counter-clockwise direction, in e.g. FIGS. 5*a-b*. The proximal alignment plane 122 and the first rotational axis 108 may then be separated by the separation distance 123 while the first rotational joint 107 rotates in a second direction opposite the first direction, when lifting the first carton blank 201 from the magazine 130, as illustrated by the clock-wise arrow at the first rotational joint 107 in FIG. 5*c*. The clock-wise rotation may thus continue while there is a separation distance 123, e.g. as shown in the further progressed momentaneous snapshot of FIG. 3*e*. Aligning the position of the first rotational axis 108 at such separation throughout the rotation in the second direction provides for optimizing the approach- and delivery paths 113, 115, further such as maximizing the amount of time the aforementioned paths are aligned substantially parallel with the stacking direction 110. A synergetic effect is obtained since by having the separation distance 123 as specified, provides for reducing the amount of clock-wise rotation of first rotational joint 107 to achieve a sufficient distance by which the first blank 201 must be lifted (i.e. the geometrical advantage), while also the amount of time available for the first rotational joint 107 to complete the clock-wise rotation can be increased, due to the discussed optimization in delaying the position of the first rotational axis 108 with a separation 123 (i.e. the temporal advantage). E.g. the latter delay may be further optimized by the movement of the first rotational axis 108 below the first longitudinal axis 125 of the first blank 201 (FIG. 4). I.e. when the first rotational joint 107 starts to rotate in the second direction (e.g. clock-wise direction in FIG. 5*c*), to lift the first carton blank 201, the first rotational axis 108 may follow a translatory movement in a direction substantially parallel with, and opposite, the stacking direction 110, as illustrated by the vertical arrow at the first rotational joint 108 in FIG. 5*c*, and as discussed above.

The pivotable linkage 102, 103, may comprise a first link 103 and a second link 102. One end of the first link 103 is connected to the gripper arm 105 via the first rotational axis 108 and an opposite end of the first link is connected to the second link 102, at a second rotational axis 132. The first and second links 102, 103, rotate in a first direction relative to each other when following the approach path 113, until the gripper head 104 arrives at the picking position 114 and contacts a first carton blank 201. The proximal alignment plane 122 and the first rotational axis 108 may be separated by the separation distance 123 while the first and second links 102, 103, rotate in a second direction relative to each other, opposite the first direction, when the gripper head 104 lifts the first carton blank 201 from the magazine 130. Thus, prior to the position of the first and second link 102, 103, in FIG. 3*a*, i.e. before the gripper head 104 has contacted the first carton blank 201, the first and second link 102, 103, may rotate relative to each other such that the first link 103 has a clock-wise rotation (in the view of e.g. FIG. 3*a*), relative the second link 102. This may provide for positioning the first rotational axis 108 with a separation distance 123 to the proximal alignment plane 122 as soon as possible in the trajectory of the approach path 113. Once the gripper head 104 contacts the first blank 201 the first link 103 may start to rotate in the opposite direction (i.e counter clock-wise) relative to the second link 102, which is illustrated in the sequence of FIGS. 3*a-e*. Positioning the first rotational axis 108 with a separation distance 123 in such manner may provide for further optimizing the trajectory of the approach- and delivery paths 113, 115, so that the motion of the gripper head 104 can be as continuous and smooth as possible, with a minimal amount of acceleration, and minimization of the movement in directions perpendicular to the stacking direction 110.

The second link 102 may be connected further to the rotary feeder 101 via a third rotational axis 133, to provide at least three degrees of freedom, which advantageously improves the extraction of the carton blanks 201 from the magazine 108.

The gripper head 104 may have an engagement surface 129 configured to contact the carton blanks 201, as illustrated in FIG. 5*a*. The engagement surface 129 forms an angle 127 with the first rotational axis 108 and the cassette direction 120. The angle 129 may be substantially zero when the gripper head 104 first contacts a first carton blank 201, prior to lifting the first carton blank 201 from the magazine 130, as shown in FIG. 5*b*. This may advantageously provide for avoiding any pushing or pulling force on the first carton blank 201 in directions other than the stacking direction 110, since the engagement surface 129 has a flat apposition against the carton blank 201. There is accordingly a minimized risk of disturbing the carton blanks 201 in other directions than in the stacking direction 110.

A filling system 200 is also disclosed comprising a feeding system 100 as described above and carton blanks 201. The feeding system 100 comprises a rotary feeder 101 comprising a pivotable linkage 102, 103. A gripper head 104 is connected to the pivotable linkage via a gripper arm 105 which is connected to an outer periphery 106 of the pivotable linkage at a first rotational joint 107, whereby the gripper arm is rotatable around a first rotational axis 108 thereof. A magazine 130 is configured to store a plurality of stacked carton blanks each having a planar configuration in a magazine plane 109 of the magazine, and the carton blanks being stacked in a stacking direction 110, parallel with the normal axis 111 to the magazine plane. The pivotable linkage is configured to be movable along a general feed path 112 such that the gripper head follows an approach path 113 towards a picking position 114 at which the gripper head engage with a carton blank in the magazine, and subsequently follows a delivery path 115, from the picking position to a delivery position 116. The magazine comprises a cassette 117 in which the carton blanks are confined, the cassette being dimensioned so that the carton blanks are confined to extend in said magazine plane between proximal 118 and distal 119 internal surfaces of the cassette along a cassette direction 120 which is perpendicular to the stacking direction and said first rotational axis. The proximal internal surface is arranged to align proximal edges 121 of the blanks in an proximal alignment plane 122 being perpendicular to the cassette direction, the proximal alignment plane extending between the gripper head and said first rotational axis, at least when the gripper head is in the picking position. At least when the gripper head is in the picking position, the first rotational joint is positioned in relation to the magazine such that there is a separation distance 123 between the proximal alignment plane and the first rotational axis, the separation distance extending in an off-set direction 124 being parallel with the cassette direction.

Figure 6:
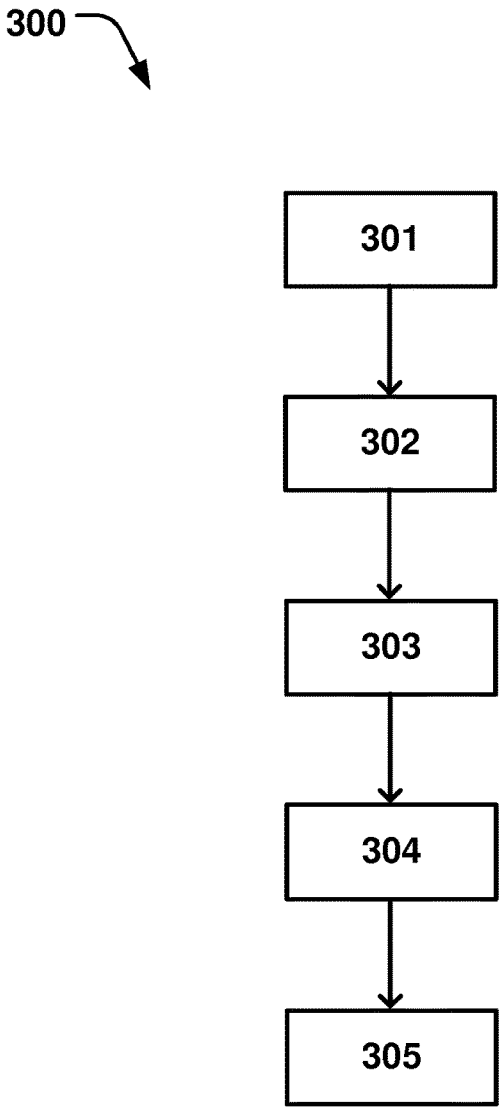
FIG. 6 is a flowchart of a method of feeding carton blanks with a rotary feeder, according to one example.

FIG. 6 illustrates a flow chart of a method 300 of feeding carton blanks 201 with a rotary feeder 101, as described above. The order in which the steps of the method 300 are described and illustrated should not be construed as limiting and it is conceivable that the steps can be performed in varying order. The rotary feeder 101 comprises a pivotable linkage 102, 103, the pivotable linkage being connected to a gripper head 104 via a gripper arm 105 at a first rotational joint 107, whereby the gripper arm is rotatable around a first rotational axis 108 thereof. The method 300 comprises moving 301 the pivotable linkage along a general feed path 112 such that the gripper head follows an approach path 113 towards a picking position 114 at which the gripper head 104 engage with a carton blank 201 in a magazine 130, and subsequently follows a delivery path 115, from the picking position 114 to a delivery position 116. The magazine 130 is configured to store a plurality of stacked carton blanks 201 each having a planar configuration in a magazine plane 109 of the magazine 130, when stored therein. The blanks 201 are stacked in a stacking direction 110, parallel with a normal axis 111 to the magazine plane 109. The magazine 130 comprises a cassette 117 in which the carton blanks 201 are confined, when stored in the magazine 130. The cassette 117 is dimensioned so that the carton blanks 201 are confined to extend in the magazine plane 109 between proximal 118 and distal 119 internal surfaces of the cassette 117 along a cassette direction 120 which is perpendicular to the stacking direction 110 and the first rotational axis 108. The proximal internal surface 118 is arranged to align proximal edges 121 of the carton blanks 201 in a proximal alignment plane 122 being perpendicular to the cassette direction 120, the proximal alignment plane 122 extending between the gripper head 104 and the first rotational axis 108, at least when the gripper head 104 is in the picking position 114. Moving the pivotable linkage 102, 103, along a general feed path 112 comprises positioning 302 the first rotational joint 107 in relation to the magazine 130 such that there is a separation distance 123 between the proximal alignment plane 122 and the first rotational axis 108, where the separation distance extends in an off-set direction 124 being parallel with the cassette direction 120. The method 300 thus provides for the above mentioned advantages discussed in relation to the feeding system 100.

The method 300 may comprise aligning 303 the approach paths 113, 113', of the first rotational axis 108 and the gripper head 104 substantially in parallel with the stacking direction 110, when the gripper head 104 is in the picking position 114, as discussed above, providing for the mentioned advantages.

Further, the method 300 may comprise aligning 304 the approach path 113 and the delivery path 115 of the gripper head 104 substantially in parallel with the stacking direction 110, when the gripper head 104 is in the picking position 114, as discussed above, providing for the mentioned advantages.

The gripper head 104 may have an engagement surface 129 configured to contact the carton blanks 201. The engagement surface 129 forms an angle 127 with the first rotational axis 108 and the cassette direction 120. The method 300 may comprise aligning 305 the gripper head 104 such that the angle 127 is substantially zero when the gripper head 104 first contacts a first carton blank 201, prior to lifting the first blank 201 from the magazine 130, as discussed above, providing for the mentioned advantages.

The present invention has been described above with reference to specific examples. However, other examples than the above described are equally possible within the scope of the invention. The different features and steps of the invention may be combined in other combinations than those described. The scope of the invention is only limited by the appended patent claims.

More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used.

What is claimed is:

1. A feeding system for carton blanks, comprising;

a rotary feeder comprising a pivotable linkage, a gripper head connected to the pivotable linkage via a gripper arm, wherein the gripper arm is connected to an outer periphery of the pivotable linkage at a first rotational joint, whereby the gripper arm is rotatable around a first rotational axis thereof, and a magazine configured to store a plurality of stacked carton blanks each having a planar configuration in a magazine plane of the magazine, when stored therein, the carton blanks being stacked in a stacking direction, parallel with a normal axis to the magazine plane, wherein the pivotable linkage comprises a first link and a second link, the first link being connected, at opposite ends thereof, to the gripper arm via the first rotational axis and the second link, wherein the pivotable linkage is configured to be movable along a general feed path such that the gripper head follows an approach path towards a picking position at which the gripper head engage with a carton blank in the magazine, and subsequently follows a delivery path, from the picking position to a delivery position, wherein the magazine comprises a cassette in which the carton blanks are confined, when stored in the magazine, the cassette being dimensioned so that the carton blanks are confined to extend in said magazine plane between proximal and distal internal surfaces of the cassette along a cassette direction which is perpendicular to the stacking direction and said first rotational axis, wherein the proximal internal surface is arranged to align proximal edges of the carton blanks in a proximal alignment plane being perpendicular to the cassette direction, the proximal alignment plane extending between the gripper head and said first rotational axis, at least when the gripper head is in the picking position, wherein, at least when the gripper head is in the picking position, the first rotational joint is positioned in relation to the magazine such that there is a separation distance between the proximal alignment plane and the first rotational axis, the separation distance extending in an off-set direction being parallel with the cassette direction, wherein the first and second links rotate in a first direction relative to each other when following the approach path, until the gripper head arrives at the picking position and contacts a first carton blank, and wherein the proximal alignment plane and the first rotational axis are separated by the separation distance while the first and second links rotate in a second direction relative to each other, opposite the first direction, when the gripper head lifts the first carton blank from the magazine.

2. The feeding system according to claim 1, wherein, when the gripper head is in the picking position and in engagement with the first carton blank extending along a first longitudinal axis being parallel with the cassette direction, the first rotational axis is positioned such that the first longitudinal axis extends between the gripper head and the first rotational axis in the stacking direction.

3. The feeding system according to claim 1, wherein the first rotational axis and the gripper head are movable along respective approach paths that are at least partly aligned substantially in parallel with the stacking direction, when the gripper head is in the picking position.

4. The feeding system according to claim 1, wherein the approach path and the delivery path of the gripper head are at least partly aligned substantially in parallel, when the gripper head is in the picking position.

5. The feeding system according to claim 1, wherein the proximal alignment plane and the first rotational axis are separated by the separation distance while the first carton blank, engaged by the gripper head, is in contact with the magazine.

6. The feeding system according to claim 1, wherein the first rotational joint rotates in the first direction when following the approach path, until the gripper head arrives at the picking position and contacts the first carton blank, and wherein the proximal alignment plane and the first rotational axis are separated by the separation distance while the first rotational joint rotates in the second direction opposite the first direction, when lifting the first carton blank from the magazine.

7. The feeding system according to claim 6, wherein, when the first rotational joint starts to rotate in said second direction, to lift the first carton blank, the first rotational axis follows a translatory movement in a direction substantially parallel with, and opposite, the stacking direction.

8. The feeding system according to claim 1, wherein the gripper head has an engagement surface configured to contact the carton blanks, wherein the engagement surface forms an angle with the first rotational axis and the cassette direction, and wherein the angle is substantially zero when the gripper head first contacts the first carton blank, prior to lifting the first carton blank from the magazine.

9. A filling system comprising a feeding system according to claim 1 and carton blanks, the feeding system comprising;

a rotary feeder comprising a pivotable linkage, a gripper head connected to the pivotable linkage via a gripper arm, gripper arm is connected to an outer periphery of the pivotable linkage at a first rotational joint, whereby the gripper arm is rotatable around a first rotational axis thereof, and a magazine configured to store a plurality of stacked carton blanks each having a planar configuration in a magazine plane of the magazine, the carton blanks being stacked in a stacking direction, parallel with the normal axis to the magazine plane, wherein the pivotable linkage comprises a first link and a second link, the first link being connected, at opposite ends thereof, to the gripper arm via the first rotational axis and the second link, wherein the pivotable linkage is configured to be movable along a general feed path such that the gripper head follows an approach path towards a picking position at which the gripper head engage with a carton blank in the magazine, and subsequently follows a delivery path, from the picking position to a delivery position, wherein the magazine comprises a cassette in which the carton blanks are confined, the cassette being dimensioned so that the carton blanks are confined to extend in said magazine plane between proximal and distal internal surfaces of the cassette along a cassette direction which is perpendicular to the stacking direction and said first rotational axis, wherein the proximal internal surface is arranged to align proximal edges of the blanks in an proximal alignment plane being perpendicular to the cassette direction, the proximal alignment plane extending between the gripper head and said first rotational axis, at least when the gripper head is in the picking position, wherein, at least when the gripper head is in the picking position, the first rotational joint is positioned in relation to the magazine such that there is a separation distance between the proximal alignment plane and the first rotational axis, the separation distance extending in an off-set direction being parallel with the cassette direction, wherein the first and second links rotate in a first direction relative to each other when following the approach path, until the gripper head arrives at the picking position and contacts a first carton blank, and wherein the proximal alignment plane and the first rotational axis are separated by the separation distance while the first and second links rotate in a second direction relative to each other, opposite the first direction, when the gripper head lifts the first carton blank from the magazine.

10. A method of feeding carton blanks with a rotary feeder comprising a pivotable linkage, the pivotable linkage being connected to a gripper head via a gripper arm at a first rotational joint, whereby the gripper arm is rotatable around a first rotational axis thereof, wherein the pivotable linkage comprises a first link and a second link, the first link being connected, at opposite ends thereof, to the gripper arm via the first rotational axis and the second link, the method comprising:

moving the pivotable linkage along a general feed path such that the gripper head follows an approach path towards a picking position at which the gripper head engage with a carton blank in a magazine, and subsequently follows a delivery path, from the picking position to a delivery position, wherein the magazine is configured to store a plurality of stacked carton blanks each having a planar configuration in a magazine plane of the magazine, when stored therein, the blanks being stacked in a stacking direction, parallel with a normal axis to the magazine plane, the magazine comprising a cassette in which the carton blanks are confined, when stored in the magazine, the cassette being dimensioned so that the carton blanks are confined to extend in the magazine plane between proximal and distal internal surfaces of the cassette along a cassette direction which is perpendicular to the stacking direction and said first rotational axis, and wherein the proximal internal surface is arranged to align proximal edges of the carton blanks in a proximal alignment plane being perpendicular to the cassette direction, the proximal alignment plane extending between the gripper head and said first rotational axis, at least when the gripper head is in the picking position, wherein moving the pivotable linkage along a general feed path comprises:

positioning the first rotational joint in relation to the magazine such that there is a separation distance between the proximal alignment plane and the first rotational axis, the separation distance extending in an off-set direction being parallel with the cassette direction, rotating the first and second links in a first direction relative to each other when following the approach path, until the gripper head arrives at the picking position and contacts a first carton blank, and rotating the first and second links in a second direction relative to each other, opposite the first direction, when the gripper head lifts the first carton blank from the magazine, while the proximal alignment plane and the first rotational axis are separated by the separation distance.

11. The method according to claim 10, comprising aligning approach paths of the first rotational axis and the gripper head substantially in parallel with the stacking direction, when the gripper head is in the picking position.

12. The method according to claim 10, comprising aligning the approach path and the delivery path of the gripper head substantially in parallel with the stacking direction, when the gripper head is in the picking position.

13. The method according to claim 10, wherein the gripper head has an engagement surface configured to contact the carton blanks, wherein the engagement surface forms an angle with the first rotational axis and the cassette direction, wherein the method comprises aligning the gripper head such that the angle is substantially zero when the gripper head first contacts the first carton blank, prior to lifting the first carton blank from the magazine.

* * * * *